US006120204A

United States Patent [19]

Rigoni

[11] Patent Number: 6,120,204

[45] Date of Patent: Sep. 19, 2000

[54] HAND WRITING INSTRUMENT WITH BUILT-IN STAMP

[76] Inventor: Herbert Rigoni, Sommerberg 16-18, D-78078 Niedereschach-Fischbach, Germany

[21] Appl. No.: 09/226,915

[22] Filed: Jan. 5, 1999

[30] Foreign Application Priority Data

Jan. 5, 1998 [DE] Germany ..... 298 00 041 U

[51] Int. Cl.[7] ..... B43K 29/013; B43K 24/06

[52] U.S. Cl. ..... 401/195; 101/327; 101/333; 401/31; 401/109; 401/112

[58] Field of Search ..... 401/31, 195, 192, 401/99, 109–114; 101/333, 327

[56] References Cited

U.S. PATENT DOCUMENTS

| | | | |
|---|---|---|---|
| 334,008 | 1/1886 | Emerson | 101/333 |
| 380,349 | 4/1888 | Reynolds | 101/333 |
| 396,233 | 1/1889 | Reynolds | 101/333 |
| 3,936,577 | 2/1976 | Christini et al. | 428/426 |
| 4,277,195 | 7/1981 | Huslik | 401/195 |
| 4,606,665 | 8/1986 | Schleif et al. | 401/195 |
| 5,048,991 | 9/1991 | Guo | 401/110 X |
| 5,108,211 | 4/1992 | Rigoni | 401/195 |
| 5,118,212 | 6/1992 | Shao . | |
| 5,547,301 | 8/1996 | Kageyama et al. | 401/112 X |

FOREIGN PATENT DOCUMENTS

| | | | |
|---|---|---|---|
| 2028611 | 3/1992 | Canada | 401/195 |
| 2672246 | 8/1992 | France | 401/195 |
| 1461616 | 4/1969 | Germany | 401/111 |
| 73 44 137 U | 4/1974 | Germany . | |
| 92 16 710 U | 4/1993 | Germany . | |
| 625 162 | 9/1981 | Switzerland . | |

OTHER PUBLICATIONS

Official Gazette, p. 296, No. US–A–396, 233, Edwin Reynolds, "Rubber Stamp", Serial No. 248,217, publication Jan. 15, 1989.

*Primary Examiner*—Henry J. Recla
*Assistant Examiner*—Kathleen J. Prunner
*Attorney, Agent, or Firm*—Pendorf & Cutliff

[57] ABSTRACT

A hand writing instrument is provided with a built-in stamp (51) and built-in stamp pad (36). The stamp (51) and stamp pad (36) are respectively provided in carriers (50, 38) which are pivotally mounted on a mounting shaft (32) in such a manner that, in the rest position, the stamp (51) and stamp pad (36) lie against each other. In the working position, the stamp carrier (50) is pivoted about a position perpendicular to the mounting shaft (32) under the influence of a spring (52). Similarly, the stamp pad carrier (38) is pivoted about an approximately perpendicular position under the influence of a spring (42). The stamp carrier (50) and the stamp pad carrier (38) are movable between a stamp position and a rest position via a cap (18) which is displaceable axially with respect to the mounting shaft (32).

7 Claims, 7 Drawing Sheets

HAND WRITING INSTRUMENT WITH BUILT-IN STAMP

BACKGROUND OF THE INVENTION

1. Field of the Invention

The invention concerns a hand writing instrument.

2. Description of the Related Art

Such a hand writing instrument is known from German Patent 33 40 293. It is a disadvantage of this known writing device, that it is only after the complete removal of the cap from the back end of the writing instrument that a spring loaded gear mechanism insures that the stamp pad carrier is automatically folded out, while the stamp carrier itself must be unfolded at the back end of the shaft by hand or by gravity.

SUMMARY OF THE INVENTION

The invention is thus concerned with the task of improving a hand writing instrument of this type in such a manner that it can be operated as well as produced in a faster and more practical manner.

After a slight sliding of the cap on the housing an automatic unfolding of stamp carrier and stamp pad is produced by spring force. A likewise slight pushing back of the cap to the return or starting position automatically pivots the two carriers against the spring force and back to their starting position parallel to the cap and to the housing.

Further embodiments of the invention concern a preferred means for locking the stamp pad carrier in the rest position, with which at the same time the open back end of the cap is closed. The slanted outer closure surface of the transverse piece of the stamp pad carrier employed therefor can advantageously be employed for advertisement purposes. It is visible even after introduction of the hand writing instrument in a jacket pocket and fulfills its advertisement purpose.

The provision of the mounting shaft fixed against rotation in the cap, and the storage of the stamp carrier in the back end of the mounting shaft, are also described below in greater detail.

The storage of the stamp pad carrier in the rest position, with the establishment of a suitable forward position of the cap, are described below in greater detail.

The suitable mechanism for operation of the writing instrument, wherein the front part of the housing is formed as a removable writing tip such that the writing insert can advantageously be introduced from the front, is also described below in greater detail.

The particular design of this mechanism, which is suitable also for other hand writing instruments, that is, hand writing instruments without stamps, is set forth in detail below.

Particularly suitable and simple is the embodiment wherein the essential parts of the hand writing instrument are produced of plastic, in particular acrylonitrile-butadiene-styrene (ABS). A particularly thin, but stable, stamp carrier can be comprised of reinforced plastic. The writing insert can be a ball-point filler or refill, an ink filler or refill, lead, or a felt tip filler or refill, which preferably is a large capacity ball-point filler or refill.

The clip for sticking on of the hand writing instrument, which clip is under strain, can be designed to be slideable onto the cap and exchangeable.

The stamp itself can be formed as a micro sponge stamp, as a conventional stamp, or as a building block stamp.

A simplification of production and assembly can be realized by the forked design of the back end of the shaft, wherein the dove-tails of the fork can be employed both for the mounting or seating of the stamp carrier as well as for mounting of the spring for tensioning this.

BRIEF DESCRIPTION OF THE DRAWINGS

By reference to the figures a preferred embodiment of the inventive hand writing instrument will be described in greater detail. There is shown.

DETAILED DESCRIPTION OF THE INVENTION

The writing instrument shown in the figures includes a housing 12 surrounding a large capacity ball-point filler 10, of which the front part forms a writing tip 14. The writing tip 14 is connected with the front end of the housing 12 via a locking mechanism described below in greater detail.

Figure 1:
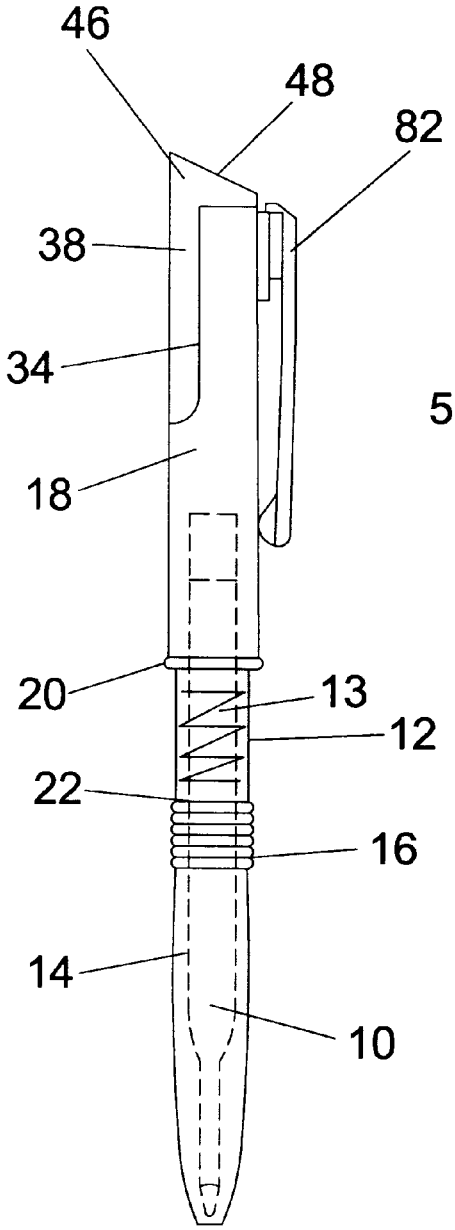
FIG. 1 a side view of a hand writing instrument in the rest position of the stamp and rest position of the writing insert, FIG. 2 a side view corresponding to FIG. 1 of the hand writing instrument in the stamp position of the stamp and writing position of the writing insert, FIG. 3 an enlarged partial section of the center area of FIG. 1, FIG. 4 an enlarged partial section of the rearward (upper) area of the FIG. 1 along line IV—IV in FIG. 5, wherein the mounting shaft and the stamp carrier are omitted for better overview, FIG. 5 a section along lines V—V in FIG. 4, FIG. 6 a 90° rotated section with respect to FIG. 4 through the upper or back end of FIG. 1, FIG. 7 side view again rotated about 90° with respect to FIG. 6 of the rearward shaft end with stamp carrier without the surrounding parts of the cap, FIG. 8 an enlarged partial view of the writing tip mechanism in the rest position, FIG. 9 partial section according to FIG. 8 of the writing tip mechanism in the writing position and FIG. 10 partial section according to FIG. 8 of the writing tip mechanism in a position which makes possible the removal of the tip.
Figure 2:
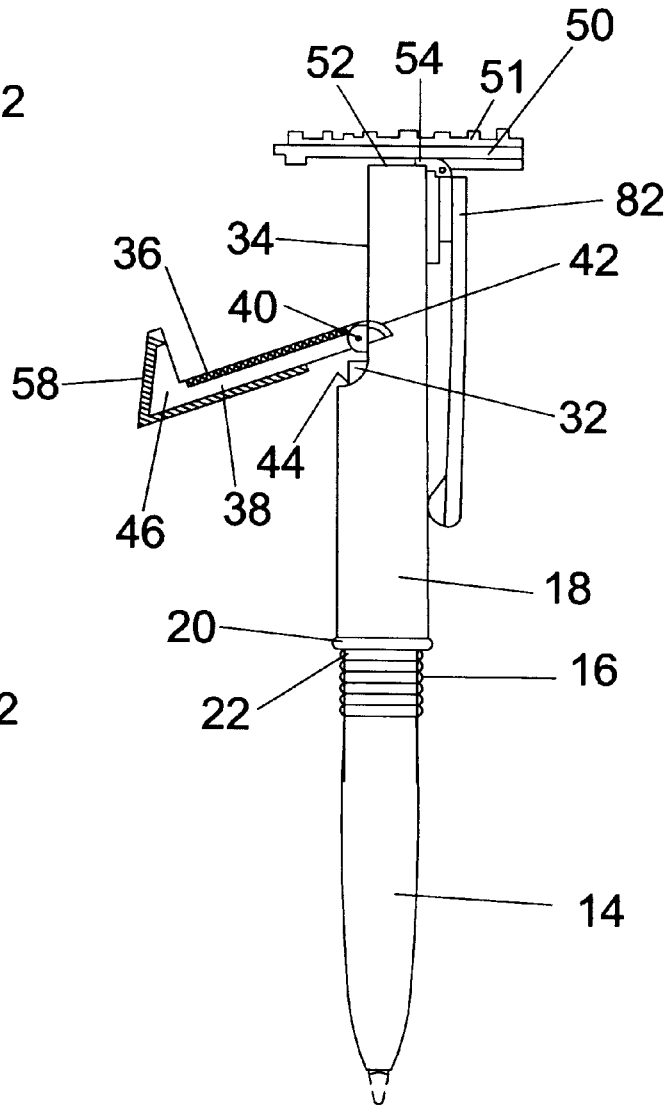

The mechanism is covered by a protective ring 16 in the representation in FIGS. 1 and 2. In the case that the mechanisms are to remain visible, then the protective ring can be formed of transparent material, preferably transparent plastic.

Figure 3:
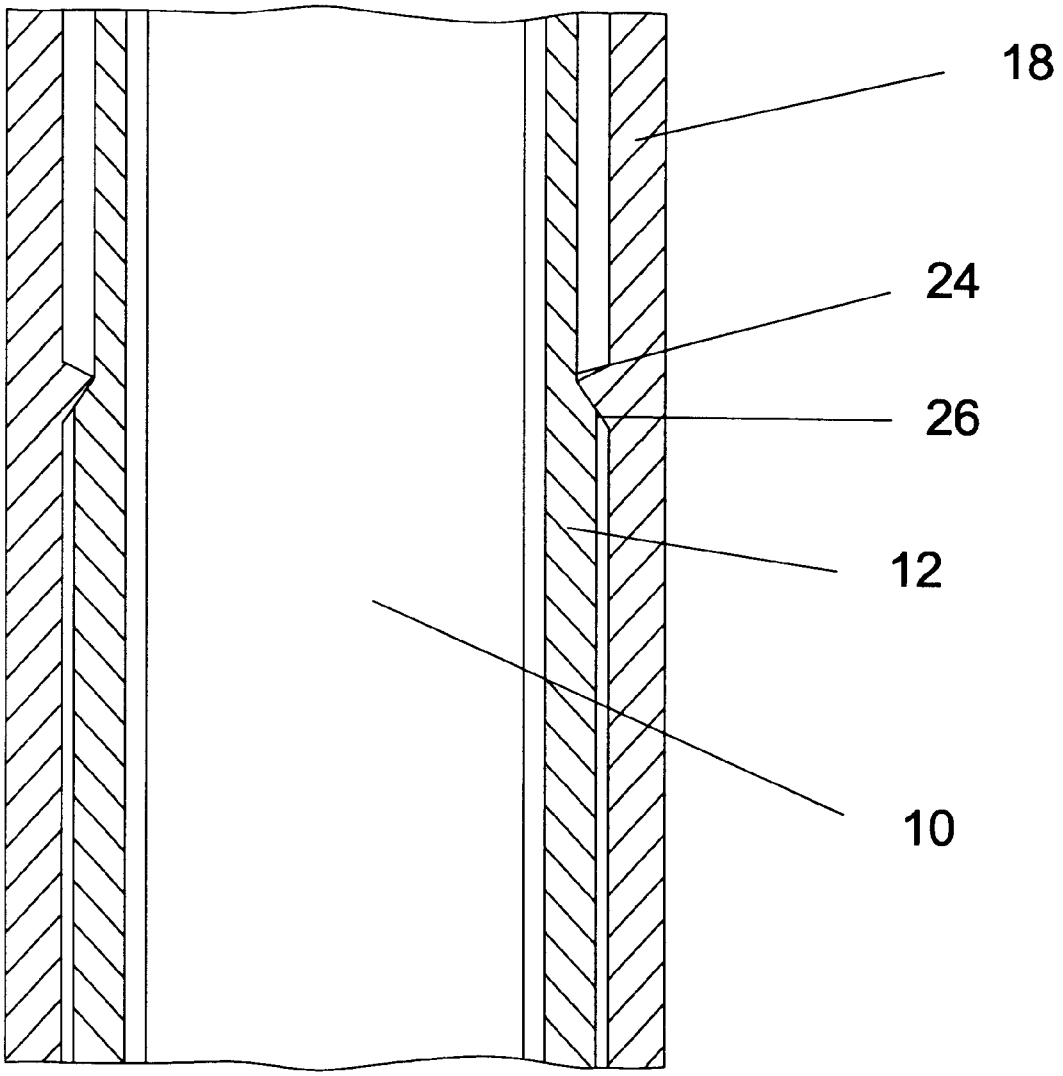

On the other side of the housing 12 a tubular shaped cap 18 is axially slidably displaceable. The front edge 20 of the cap 18 forms a stop collar, which in the rearwards rest position of the cap 18 shown in FIG. 1 is spaced apart from a corresponding impact or stop collar 22 on the housing 12. In the forward position shown in FIG. 2, namely the stamping position, the stop collar 20 abuts against the stop collar 22, so that the two stop collars 20, 22 determine the forward position of the cap 18. This insures the possibility of a sliding of the cap 18 for the purpose of stamping even during a deployment of the writing insert 14. A limitation of the retracted position of the cap is achieved in a manner which can be seen from FIG. 3 by the inwardly oriented abutment tabs 24 on the inner side of the cap 18, which in the position according to FIG. 1 abut against a rearwards facing collar 26 of the housing 12.

The cap 18 exhibits in the rearward area a sideward recess 34, in which according to FIG. 1 a stamp pad carrier 38 carrying a stamp pad 36 is snuggly introduced in the rest position. The inner or front end of the stamp pad carrier 38 is mounted pivotably about an axis 40 on mounting shaft 32 and is tensioned or biased via the spring 42 towards a stamping position represented in FIG. 2 running approximately perpendicular to the longitudinal axis of the writing instrument. The folding out of the stamp pad carrier 38 via the spring 42 can only occur when the cap 18 is pushed on the housing 12 out of the retracted rest position according to FIG. 1 towards the forward stamp position according to FIG. 2. As soon as the cap 18 is again pushed back into the rest position according to FIG. 1, then a rearwards facing edge or rim 44 of the recess 34 impacts against the stamp pad carrier 38 and urges this into the folded-in rest position according to FIG. 1. In this position a transverse piece 46 engages at the rearward end of the stamp pad carrier 38 via the open rearward end of the cap 18 and closes this. The locking of the transverse piece 46 in this position is described further below by reference to FIGS. 4 and 5. The outer end or closing off surface 48 of the transverse piece 46 is slanted with respect to the longitudinal axis of the hand writing instrument and preferably serves as an advertising surface, which remains visible even after insertion of the writing instrument into a jacket pocket or the like. This somewhat recessed closure surface 48 can be covered over with a not shown magnifying lens, of which the angular or warped edges engage in recesses 61*a* and 61*b* in the jacket surface of the transverse piece 46.

Figure 6:
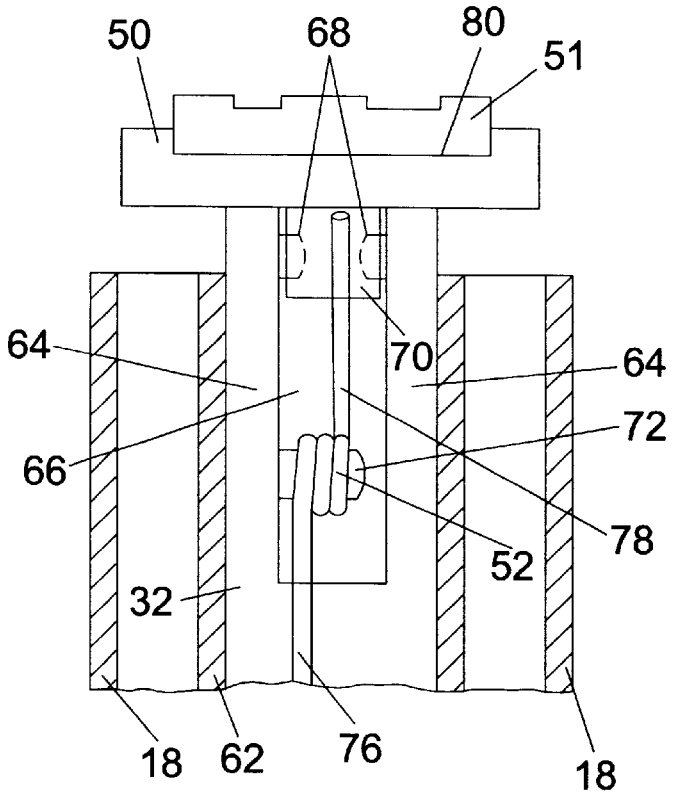
Figure 7:
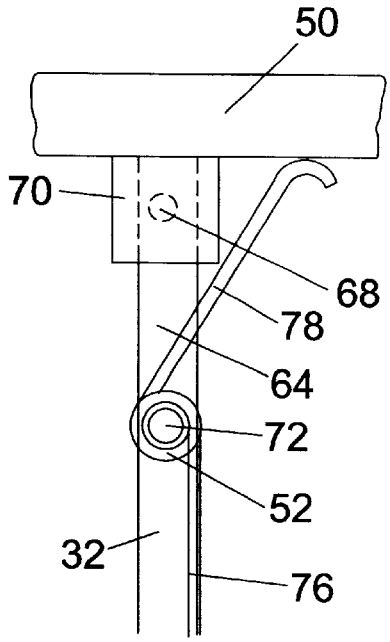

At the same time as the pivoting-out of the stamp pad carrier 38 there occurs during pushing forward of the cap 18 over the housing 12 the releasing of a likewise plate-shaped stamp carrier 50 carrying stamp 51, which immediately after its release is folded out of the position oriented parallel to the longitudinal axis of the writing instrument (FIG. 1) into the position perpendicular to this longitudinal axis represented in FIG. 2 by means of a shank spring 52 described in greater detail below on the basis of FIGS. 6 and 7. The stamp carrier 50 is, in a manner further described below in greater detail, pivotably mounted approximately centrally on the rearward end of the mounting shaft 32. During the pushing back of the cap 18 out of the forward position according to FIG. 2 into the rearward position according FIG. 1, first stamp carrier 50 is folded into the recess 34 of the cap 18 against the force of the spring force 52 by the rearward rim 54 of the cap 18 and subsequently the stamp pad carrier 38 is folded-in likewise in the indicated manner.

Figure 5:
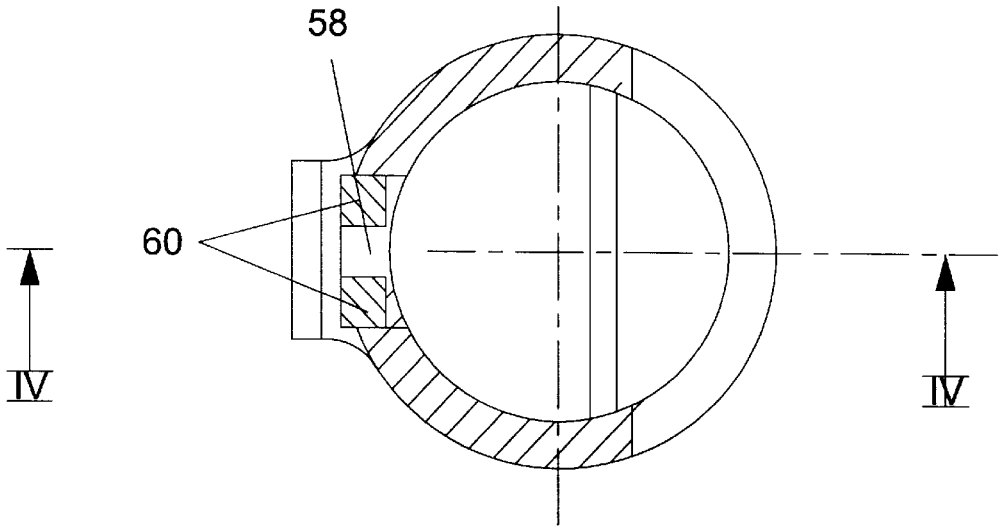
Figure 4:
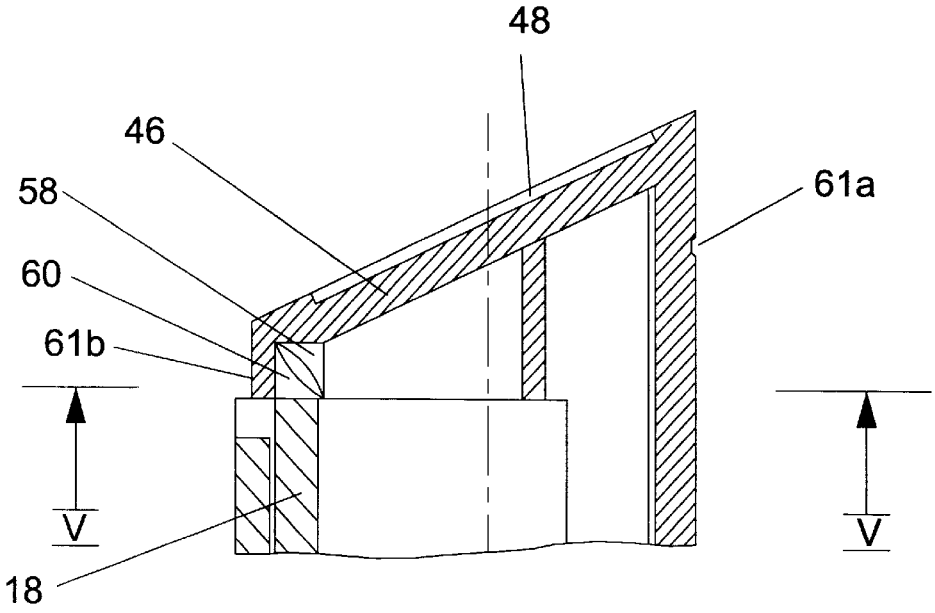

From FIGS. 4 and 5 it can been seen that the transverse piece 46 is locked in the rest position at the rearwards end of the cap 18 according to FIG. 1. The transverse piece 46 exhibits an axial recess 58, in which in the rest position of the stamp pad carrier 38 according to FIG. 4 axial projections 60 at the rearward end of the cap 18 lockingly engage. Should the cap 18 be slid in its forward position according to FIG. 2, then the projections 60 are pulled out of the recess 58 and the stamp pad carrier 38 is automatically folded outwards by the action of the spring 42. Between guide rails 62 the mounting shaft 32 is guided in a manner which, as can be seen from FIG. 6, is slideable in the longitudinal direction, however, is secured against rotation.

As can further been seen from FIG. 6, the rearwards end of the mounting shaft 32 is split into two parallel fork prongs 64, which form a pocket or cutout 66 between them. Close to the rearwards end of both fork prongs 64 there is respectively one mounting post 68 provided directed into cutout 66, upon which an attachment piece 70 positioned approximately centrally to the stamp carrier 50 is pivotably mounted. Further inwards in the cutout 66 a plug 72 is provided on the one fork prong 64 directed into the cutout 66, upon which a shank spring 52 is seated. The plug 72 does not however extend to the inner side of the oppositely lying fork prong 64, so that the spring 52 can be introduced into the cutout by hand in such manner be introduced thereupon, that the spring 52 cannot come off by itself. One shank 76 of the shank spring 52 is, in a manner not shown in greater detail, abutted or supported against the mounting shaft 32, while the rearwards directed shank 78 biases the stamp holder 50 into its stamp position according to FIGS. 2, 6 and 7.

The stamp carrier 50 exhibits a recess 80 on its outer surface, into which a not-shown stamp of conventional type can be seated. The clip 82 which can be seen from FIGS. 1 and 2 for clipping on of the hand writing instrument is, in likewise not in greater detail illustrated manner, slideable upon the cap 18 and can thus can be removed and changed.

Figure 8:
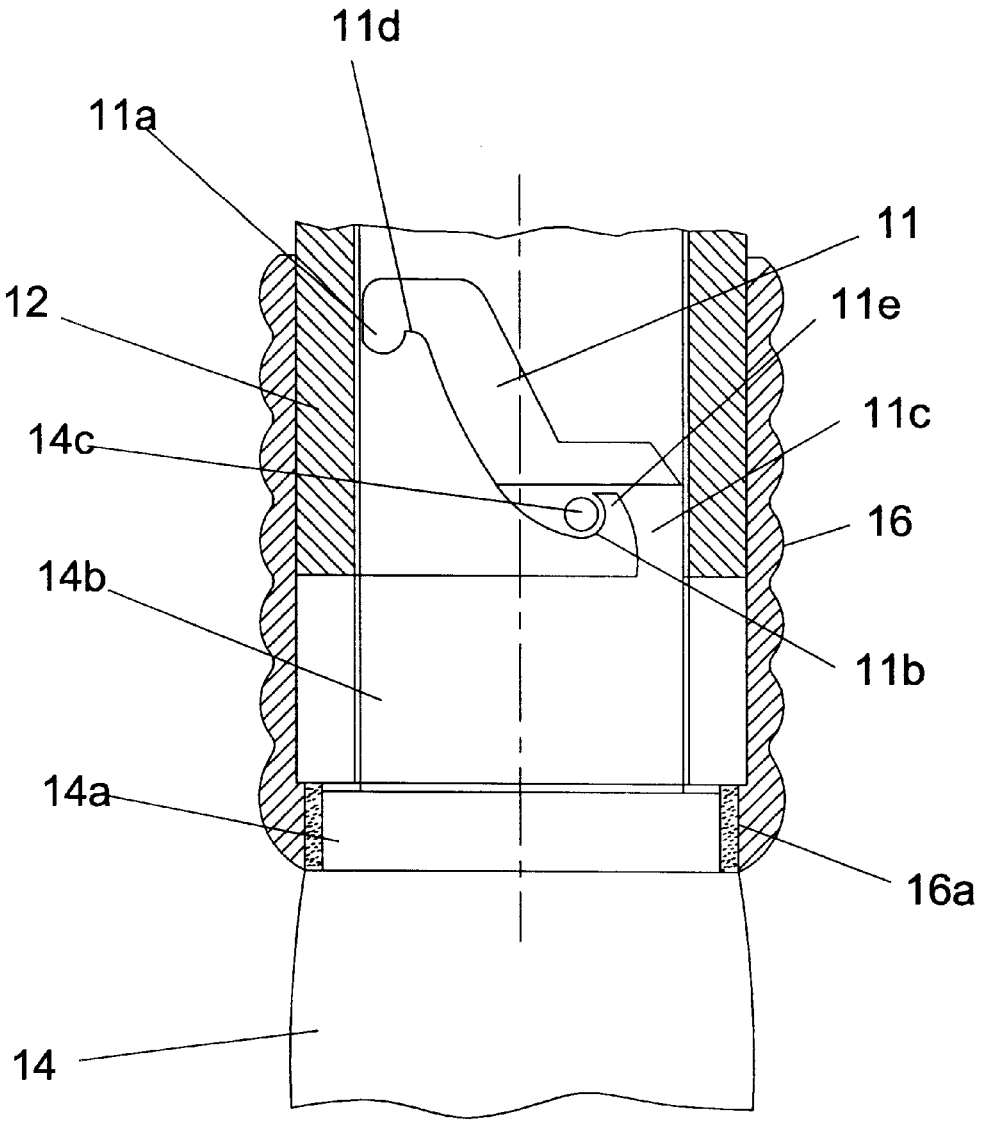
Figure 9:
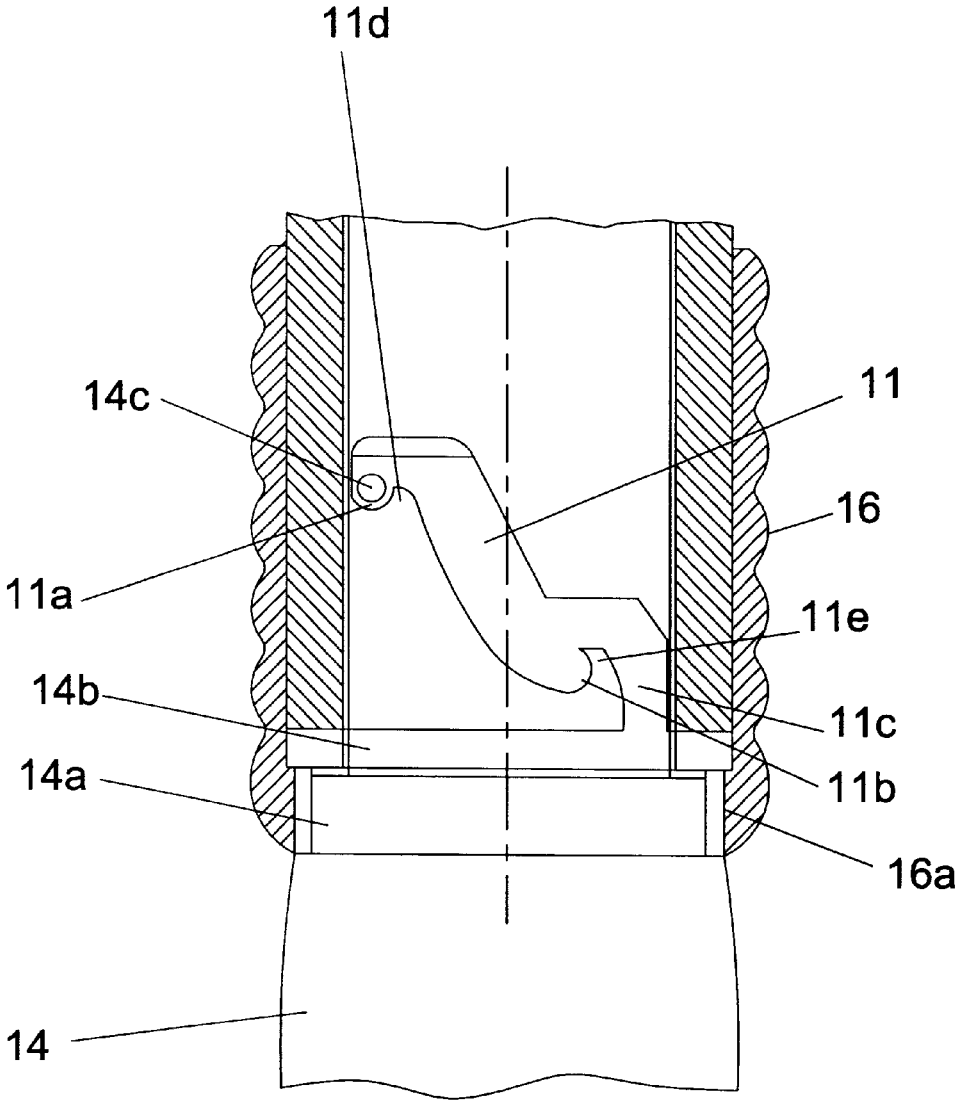

A particularly preferred writing tip mechanism for the hand writing instrument is represented in FIGS. 8 through 9, with which, by rotation of the writing tip 14, the ball point writing filler can be brought out of its rest position to a working position. Besides this the mechanism is so designed, that the writing tip 14 can be completely released from the housing 12, in order that the writing insert, not shown in FIGS. 8 through 10, can be inserted into the writing instrument from the front.

Figure 10:
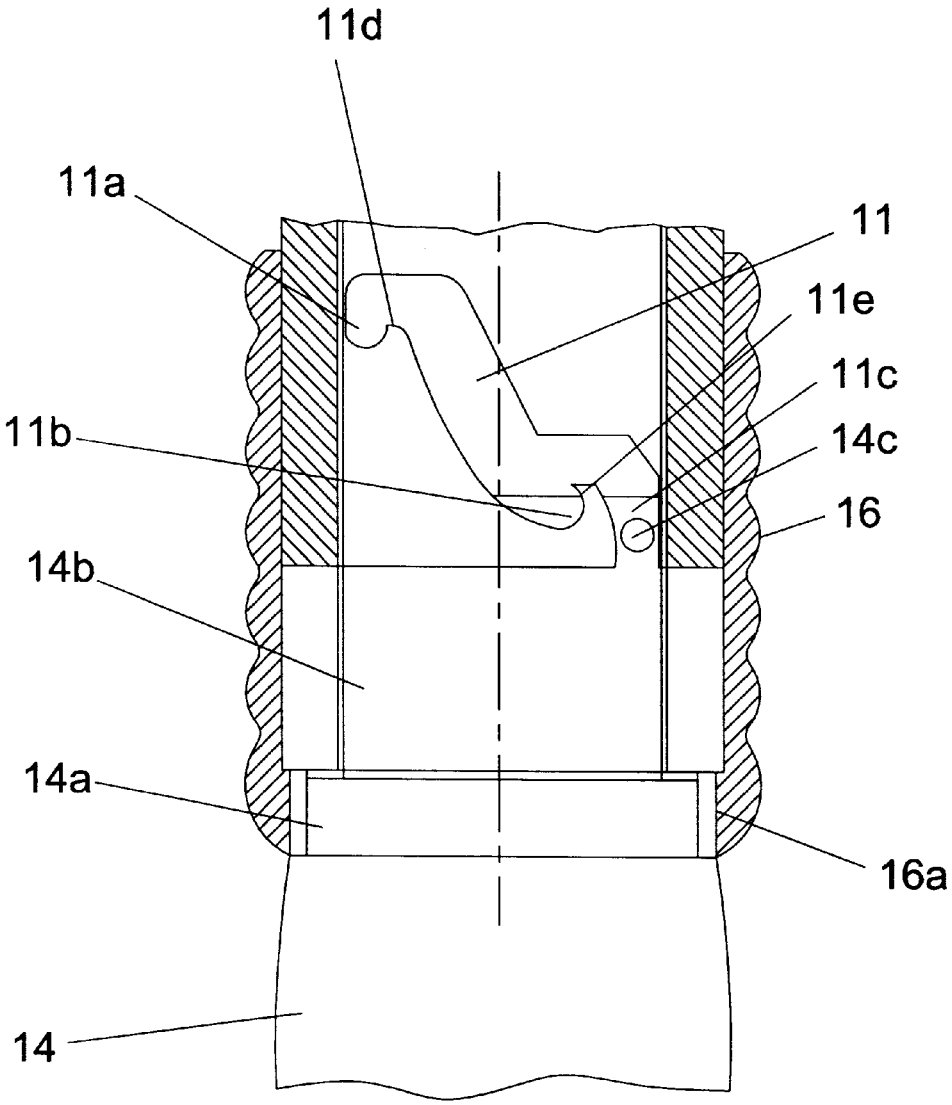

In FIGS. 8 through 10 there is essentially shown in enlarged representation the area in the neighborhood of the protective ring 16 of the writing instrument.

The writing tip 14, of which only the upper part is recognizable in FIGS. 8 through 10, exhibits on its rearwards end two segments 14*a* and 14*b*, of a smaller diameter in comparison to the diameter of the writing tip 14. The rearward, longer segment 14*b* of the writing instrument is mounted axially slidable and rotatable within the tubular shaped housing 12. The housing 12 is provided with at least diametrically opposing guide curves 11, which on their upper ends exhibit a writing position determining detent 11*a* and their lower end a rest position determining detent 11*b*. Besides this the guide curves 11 have an, in the direction of the writing tip, open introduction canal 11*c*.

In these guide curves 11 there engages a radially projecting tab or post 14*c*, which is connected with a segment 14*b* of the writing tip 14. The length corresponds to the wall strength of the housing 12 and projects beyond this non-radially.

The segment of the housing 12 with the guide curves 11 is completely covered by a protective ring 16. This protective ring 16 is rotationally and slidably mounted upon the housing 12 and engages with an inwards projecting collar 16*a* in the ring-shaped intermediate space between the housing 12 and the writing tip 14. In this manner it is secured to the writing instrument so that it cannot be lost. It is provided in a not shown manner in the area of 16*a* with axially extending grooves or notches of which the breadth corresponds to the cross-section of the plugs or tabs 14*c*, so that the writing tip 14 can be taken out of the position shown in FIG. 10 by rotation of the protective ring 16 in the position corresponding to the post or tabs 14*c*.

In the position shown in FIG. 8 the posts or tabs, of which exemplarity only one tab 14*c* is shown, are in the respective lower detent 11*b* so that the writing instrument is found in its forward most position. In this position the ball point filler, which in the housing 12 is connected axially non-slidably, is laid completely within the writing instrument 14 is laid. It is thus in the rest position.

If the writing tip 14 is slid forward upon the housing with slight rotation, then the tab 14*c* travels out of the lower detent 11*b* into the upper detent 11*a*. By the action of a spiral spring 13 which is provided within the writing tip 14 between the writing filler and the writing tip, the tab 14*c* and therewith the writing tip 14 are pressed forwards and arrested. In this position the forward end of the writing insert projects beyond the writing tip 14; it is thus in the writing position.

The detents 11*a* and 11*b* are respectively bordered or limited by abutments 11*d* and 11*e*. In order to bring the writing tip 14 out of the writing position shown in FIG. 9 and into the rest position shown in FIG. 8, then the writing tip must be slid slightly relative to the housing 12, in order to lift the tab 14*c* [sic] out of the detent 11*a* and over the abutment lid. Under the action of the mentioned and not-shown pressure spring, the writing tip 14 is pushed forwards, until the tab 14*c* again engages or is found in the position represented in FIG. 8.

In order to disassemble the writing tip 14 for purposes of filler changing, the writing tip 14 is to be lifted out in such a manner and then slightly to be rotated, so that the tab 14*c* is lifted slightly out of the detent 11*b* and by rotation over the abutment 11*e* is lifted, whereupon, again under the action of the tensioned screw spring, the writing tip 14 is pushed further forwards, whereby the tab 14*c*, as can be seen in FIG. 10, can pass by the insertion canal 11*c*. Next the writing tip 14 allows itself to be separated from the housing 12, whereupon the writing insert can be removed and replaced by a refill cartridge or lead.

The assembly of the writing tip is accomplished in the reverse order.

The protective ring 16 serves for covering, and therewith protection, of the writing tip mechanism with the guide curves 11 and the therewith cooperating tabs 14*c*. In the case that the mechanism should remain observable for the user, then this protective ring is preferably comprised of a transparent material.

In order to make possible the assembly of the writing tip 14 in the various angular positions and therewith to simplify the assembly, it is recommended to provide multiple pairs of guide curves 11 distributed around the circumference at the lower end of the housing 12.

What is claimed is:

1. Hand writing instrument defined by a housing with built-in stamp and built-in stamp pad, wherein the stamp and the stamp pad are secured to a plate-shaped stamp carrier and stamp pad carrier, respectively, and both stamp carrier and stamp pad carrier are mounted on a mounting shaft so as to be pivotable between a rest position parallel to the mounting shaft and stamp position perpendicular or nearly perpendicular thereto, with a writing insert provided in the housing and a cap longitudinally slidingly displaceable between a forward and a rearward position and surrounding the mounting shaft and the stamp carrier and stamp pad carrier when oriented in the rest position, wherein the stamp carrier (50) and stamp pad carrier (38) are biased out of the rest position and into the stamp position by respectively one spring (42, 52), are held in the rest position by the cap (18) when situated in the rearwards position, are automatically folded out into the stamp position during a sliding of the cap (18) into a forwards position and are folded into the rest position by the cap during a sliding of the cap (18) into the rearwards position, wherein the cap (18) close to its rearwards open end (54) exhibits at least one axial projection (60), which engages in an axial recess (58) a transverse piece (46) of the stamp pad carrier (38) locking the cap (18) rearwards, when the cap (18) is positioned in its rearwards position.

2. Hand writing instrument according to claim 1, thereby characterized, that the transverse piece (46) exhibits a slanted outer closure surface.

3. Hand writing instrument defined by a housing with built-in stamp and built-in stamp pad, wherein the stamp and the stamp pad are secured to a plate-shaped stamp carrier and stamp pad carrier, respectively, and both stamp carrier and stamp pad carrier are mounted on a mounting shaft so as to be pivotable between a rest position parallel to the mounting shaft and stamp position perpendicular or nearly perpendicular thereto, with a writing insert provided in the housing and a cap longitudinally slidingly displaceable between a forward and a rearward position and surrounding the mounting shaft and the stamp carrier and stamp pad carrier when oriented in the rest position, wherein the stamp carrier (50) and stamp pad carrier (38) are biased out of the rest position and into the stamp position by respectively one spring (42, 52), are held in the rest position by the cap (18) when situated in the rearwards position, are automatically folded out into the stamp position during a sliding of the cap (18) into a forwards position and are folded into the rest position by the cap during a sliding of the cap (18) into the rearwards position, wherein between the mounting shaft (32) and the writing insert (10) a mechanism is provided for operation of the writing insert between a rest position in the housing and a writing Position projecting out of the housing, wherein a writing tip is rotatably and slidably connected within the housing, and the writing insert is provided to be axially not slideable in the housing, wherein between the writing insert (10) and the writing tip (14) a pre-tensioned pressure spring is provided, wherein on the housing (12) there are provided at least one pair of diametrically oppositely lying guide curves (11) with an upper and a lower détente (11*a*, 11*b*), and wherein the writing tip (14) with its rearward section (14*b*) is mounted axially slideable and rotatable on the housing (12) and exhibits radial projecting tabs (14*c*) which engage in the guide curves (11) in such a manner, that by rotation thereof the writing tip (14) can be moved from a writing insert (10) covering rest position into a writing insert (10) exposing writing position.

4. Hand writing instrument according to claim 3, wherein, the guide curves (11) include an insertion canal (11*c*) opening in the direction of the writing tip (14) for the passage of the tabs (14*c*) during assembly and disassembly of the writing tip (14).

5. Hand writing instrument according to claim 3, wherein, the guide curves (11) are surrounded by a protective ring (16) provided upon the housing (12).

6. Hand writing instrument according to claim 5, wherein, the protective ring (16) engages with a collar (16*a*) in an intermediate space between the housing (12) and writing tip (14), preferably rotatably and slightly slideably, and so is connected with the writing instrument so that it cannot be lost.

7. Hand writing instrument according to claim 6, wherein, the protective ring (16) is made of a transparent material.

* * * * *